US008434599B2

(12) United States Patent
Wang et al.

(10) Patent No.: US 8,434,599 B2
(45) Date of Patent: May 7, 2013

(54) MULTIPLE CAR HOISTWAY INCLUDING CAR SEPARATION CONTROL

(75) Inventors: Cheng-Shuo Wang, Ellington, CT (US); Arthur C. Hsu, South Glastonbury, CT (US); CheongSik Shin, Seoul (KR); Hansoo Shim, Seoul (KR); SeongRak Jeong, Seoul (KR)

(73) Assignee: Otis Elevator Company, Farmington, CT (US)

( * ) Notice: Subject to any disclaimer, the term of this patent is extended or adjusted under 35 U.S.C. 154(b) by 373 days.

(21) Appl. No.: 12/678,880

(22) PCT Filed: Sep. 18, 2007

(86) PCT No.: PCT/US2007/020142

§ 371 (c)(1),
(2), (4) Date: Mar. 18, 2010

(87) PCT Pub. No.: WO2009/038551

PCT Pub. Date: Mar. 26, 2009

(65) Prior Publication Data

US 2010/0213012 A1 Aug. 26, 2010

(51) Int. Cl.
*B66B 9/00* (2006.01)

(52) U.S. Cl.
USPC ..... 187/249; 187/293

(58) Field of Classification Search ..... 187/247–249, 187/277, 279, 282, 286–295, 300, 305, 391–394
See application file for complete search history.

(56) References Cited

U.S. PATENT DOCUMENTS

| | | | | |
|---|---|---|---|---|
| 5,419,414 | A * | 5/1995 | Sakita | 187/391 |
| 5,482,143 | A * | 1/1996 | Saito | 187/394 |
| 5,663,538 | A | 9/1997 | Sakita | |
| 5,877,462 | A | 3/1999 | Chenais | |
| 7,353,912 | B2 | 4/2008 | Reuter et al. | |
| 7,448,471 | B2 * | 11/2008 | Nuebling | 187/286 |
| 7,487,860 | B2 * | 2/2009 | Hikita et al. | 187/249 |
| 7,819,228 | B2 * | 10/2010 | Terry et al. | 187/249 |
| 7,917,341 | B2 * | 3/2011 | Sansevero et al. | 703/1 |
| 8,020,668 | B2 * | 9/2011 | Hsu et al. | 187/249 |
| 8,136,635 | B2 * | 3/2012 | Christy et al. | 187/249 |
| 2005/0279584 | A1 | 12/2005 | Reuter et al. | |

FOREIGN PATENT DOCUMENTS

| | | |
|---|---|---|
| EP | 0769469 A1 | 4/1997 |
| EP | 1118573 B1 | 7/2001 |

(Continued)

OTHER PUBLICATIONS

Office Action of the Korean Patent Office dated Oct. 26, 2011, in counterpart Application No. 10-2010-7008397.
Office Action of the Japanese Patent Office dated May 8, 2012, in counterpart Application No. 2010-525784.

(Continued)

*Primary Examiner* — Anthony Salata
(74) *Attorney, Agent, or Firm* — Kinney & Lange, P.A.

(57) ABSTRACT

A separation distance is maintained between a leading elevator car (14) and a trailing elevator car (12) traveling in the same direction in an elevator hoistway (16). A shortest stopping distance ($d_{ssl}$) of the leading elevator car (14) and a normal stopping distance ($d_{nst}$) of the trailing elevator car (12) are determined. The separation distance ($d_{sep}$) is controlled such that a difference between the normal stopping distance ($d_{nst}$) of the trailing elevator car (12) and the shortest stopping distance ($d_{ssl}$) of the leading elevator car (14) is greater than or equal to a threshold distance ($d_{thresh}$).

19 Claims, 2 Drawing Sheets

FOREIGN PATENT DOCUMENTS

| | | | |
|---|---|---|---|
| EP | 2022742 | A1 | 2/2009 |
| JP | 2006240798 | A | 9/2006 |
| KR | 2005072821 | A1 | 7/2005 |
| WO | WO2004043842 | A1 | 5/2004 |

OTHER PUBLICATIONS

Office Action of the Korean Patent Office dated May 31, 2012, in counterpart Application No. 10-2010-7008397.

* cited by examiner

MULTIPLE CAR HOISTWAY INCLUDING CAR SEPARATION CONTROL

BACKGROUND

The present invention relates to elevator control systems. More specifically, the present invention relates to controlling the distance between a leading elevator car and a trailing elevator car traveling in the same direction in an elevator hoistway.

An objective in elevator system design is to minimize the required number of elevator hoistways that are employed within the elevator system, while also trying to effectively meet the transportation needs of passengers and freight within the building. Solutions aimed at reducing the number of hoistways and improving service have included higher elevator travel speeds, shorter door opening and closing times, advanced control systems, express elevators, splitting buildings into zones, and so on. However, in buildings having a large number of stories, these measures may result in a feeling of unease when elevators accelerate, inconvenience when doors quickly close, or frustration as a result of using a complicated system, where passengers may have to change between elevator cars one or more times to get to a desired floor.

One approach to increasing the efficiency of passenger transport while minimizing the number of elevator hoistways is to incorporate multiple independently controllable elevator cars into each hoistway that are each capable of servicing most or all of the floors in the building. In such a system, each elevator car must be separated from the others by a certain distance for safe operation of the elevator cars. When two or more elevator cars are traveling in the same direction in the hoistway, the timing of the runs assigned to the elevator cars becomes important with respect to anticipated and unanticipated stops to avoid interference between the elevator cars.

In light of the foregoing, the present invention aims to resolve the need to ensure a sufficient and proper separation distance between elevator cars traveling in the same direction in a hoistway.

SUMMARY

The present invention relates to maintaining a separation distance between a leading elevator car and a trailing elevator car traveling in the same direction in an elevator hoistway. A shortest stopping distance of the leading elevator car and a normal stopping distance of the trailing elevator car are determined. The separation distance is controlled such that a difference between the normal stopping distance of the trailing elevator car and the shortest stopping distance of the leading elevator car is greater than or equal to a threshold distance. In other words, the separation distance is controlled such that the shortest resultant stopping position of the leading car (which is the position at which the leading car would stop under emergency stopping conditions) will be separated from the normal resultant stopping position of the trailing car (which is the position at which the trailing car would stop under normal stopping conditions) by at least a threshold distance.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are hereafter briefly described.

DETAILED DESCRIPTION

Figure 1:
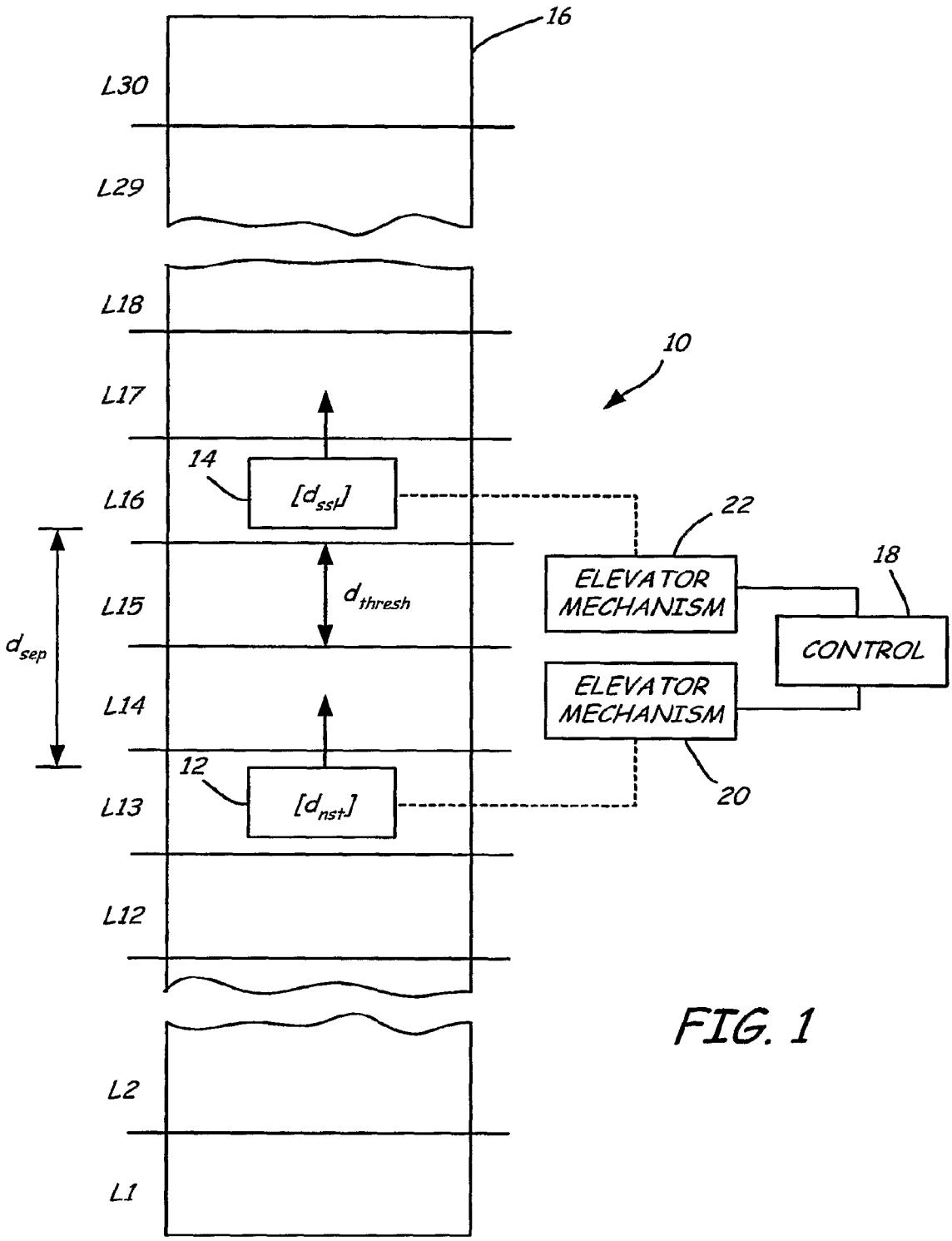
FIG. 1 is a schematic view of an embodiment of an elevator system including multiple independently controllable elevator cars operable to travel in the same direction in a hoistway.

Efforts have been made throughout the drawings to use the same or similar reference numerals for the same or like components.

FIG. 1 is a schematic view of elevator system 10 including first elevator car 12 and second elevator car 14 vertically disposed with respect to each other in hoistway 16. In this example, hoistway 16 is located in a building having thirty floors including floor levels L1-L30 and is configured to allow first elevator car 12 and second elevator car 14 to service passenger demands on most or all of the floors. Controller 18 is connected to first elevator mechanism 20 and second elevator mechanism 22. First elevator mechanism 20 includes the mechanical assembly for operation of first elevator car 12, and second elevator mechanism 22 includes the mechanical assembly for operation of second elevator car 14.

Elevator cars 12 and 14 are independently controlled by controller 18 (via elevator mechanisms 20 and 22, respectively) based on demands for service received on call devices on floors L1-L30. Controller 18 receives service requests from passengers on levels L1-L30 and controls elevator cars 12 and 14 to efficiently and safely transport the passengers to their respective destination floors. Controller 18 monitors and controls the location, speed, and acceleration (which may be positive or negative) of each of elevator cars 12 and 14 while elevator cars 12 and 14 are servicing passenger requests. In some embodiments, controller 18 determines the location and speed of elevator cars 12 and 14 based on the data provided to controller 18 by position and speed sensors in elevator mechanisms 20 and 22, respectively.

Hoistway 16 may be configured such that elevator car 12 services all but the uppermost floor that is inaccessible due to the presence of elevator car 14, and such that elevator car 14 services all but the lowermost floor that is inaccessible due to the presence of elevator car 12. Alternatively, hoistway 16 may include a parking area below level L1 such that elevator car 12 may be temporarily parked to allow elevator car 14 to service requests to level L1. Similarly, hoistway 16 may include a parking area above level L30 such that elevator car 14 may be temporarily parked to allow elevator car 12 to access level L30. It should be noted that while thirty levels L1-L30 are shown, elevator system 10 may be adapted for use in a building including any number of floors. In addition, while two vertically disposed elevator cars 12 and 14 are shown, hoistway 16 may include any number of elevator cars operable to service most or all of the floors in the building.

When service demands require elevator cars 12 and 14 to travel in the same direction in hoistway 16, controller 18 controls the distance between elevator cars 12 and 14 to assure that the trailing car of the two cars can stop at a substantially normal (i.e., controlled) rate if the leading car of the two cars makes a sudden stop (e.g., an emergency stop). A "normal" stopping rate (and "under normal stopping conditions") is to be understood to mean the controlled rate at which the car is slowed and stopped for a given speed of travel. Accordingly, as the "normal" stop may be initiated at any time due to a corresponding emergency stop, it is possible that the trailing car will not be stopped adjacent an elevator landing.

For example, if elevator car 12, which is located on level L13, is assigned to service a passenger request on level L17, and elevator car 14, which is located on level L16, is assigned to service a passenger request on level L20, both elevator cars move upwardly in hoistway 16 to service their respective demands. In this example, elevator car 14 is the leading car and elevator car 12 is the trailing car. Controller 18 controls elevator mechanism 20 to assure that, at all times, if the leading car 14 suddenly stops under abnormal (e.g., emergency) braking conditions, the trailing elevator car 12 will be able to stop under normal stopping conditions and thereafter be at least a minimum or threshold distance from the leading elevator car 14.

To determine the appropriate separation between elevator cars 12 and 14, controller 18 considers the various parameters that make up the motion profile for each elevator car. The parameters that affect the time change in position for a complete trip is termed the "motion profile" of the elevator car. For example, controller 18 may set a motion profile for each of elevator cars 12 and 14 that is related to the maximum acceleration, maximum steady state speed, maximum deceleration, direction (up or down), and jerk (i.e., the third time derivative of position) of each elevator car under normal operating conditions.

As the speed, direction, acceleration, etc. for each of the cars 12, 14 will change over the course of their trajectories, the separation distance $d_{sep}$ between the cars 12 and 14 must also change, i.e., the separation distance $d_{sep}$ is a dynamic value. Controller 18 controls the separation distance $d_{sep}$ between elevator cars 12 and 14 traveling in the same direction by continuously (or periodically) determining the shortest stopping distance $d_{ssl}$ of the leading car and the normal stopping distance $d_{nst}$ of the trailing car. In the example above, elevator car 14 is the leading car. Shortest stopping distance $d_{ssl}$ is the distance it takes leading elevator car 14 to stop when leading elevator car 14 is slowed at maximum deceleration. Leading elevator car 14 may be slowed at maximum deceleration when an emergency brake is applied in an emergency condition, for example. Shortest stopping distance $d_{ssl}$ is a function of at least the speed, direction, acceleration, and jerk of elevator car 14, as well as the load in elevator car 14. Controller 18 may determine the speed, direction, acceleration, and load of leading elevator car 14 based on data provided by sensors associated with leading elevator car 14 and/or elevator mechanism 22, for example. In the example above, elevator car 12 is the trailing car. The normal stopping distance $d_{nst}$ trailing elevator car 12 may be determined based on the motion profile for trailing elevator car 12 stored in controller 18, as well as the speed, direction, acceleration, and load of trailing elevator car 12. It should be noted that the normal stopping distance $d_{nst}$ is not necessarily a function of the deceleration rate of trailing elevator car 12 under normal operating conditions, but rather may be a function of any deceleration rate that maintains a minimum level of comfort for the passengers in trailing elevator car 12.

As stated above, controller 18 continuously (or periodically) determines the normal stopping distance $d_{nst}$ of trailing elevator car 12 and the shortest stopping distance $d_{ssl}$ of leading elevator car 14 based on measured load and motion (e.g., speed, direction, acceleration, and jerk) parameters of each elevator car 12 and 14. These continuous (or periodic) determinations may be calculated using models employing simulations, numerical methods, analytic formulas, or the like based on the motion profiles of elevator cars 12 and 14. Controller 18 may also compare the measured load and motion parameters of each elevator car 12 and 14 to data stored in a lookup table or the like to determine the instantaneous normal stopping distance $d_{nst}$ and shortest stopping distance $d_{ssl}$. In any case, normal stopping distance $d_{nst}$ of trailing elevator car 12 and shortest stopping distance $d_{ssl}$ of leading elevator car 14 are determined real-time as the speed, direction, acceleration, and load of each of elevator cars 12 and 14 vary over time. As such, when both elevator cars 12 and 14 are traveling at full speed, the separation distance that is maintained between elevator cars 12 and 14 is larger than the separation distance that is maintained between the elevator cars 12 and 14 when the cars are either just beginning to move or are almost stopped under normal stopping conditions.

Controller 18 assures that the separation distance $d_{sep}$ between the cars 12 and 14 is such that at any time if the leading car 14 is forced to stop under emergency braking conditions, the trailing car 12 will be able to stop under normal stopping conditions and resultantly yield a distance between the cars 12 and 14 that is greater than or equal to a threshold distance $d_{thresh}$. In some embodiments, the threshold distance is about one or two floor levels; in other embodiments, the threshold distance could be significantly less than one floor (so that the cars can simultaneously receive passengers on adjacent floors) or be more than two floors. The threshold distance $d_{thresh}$ may also include a safety margin to allow for measurement errors that may occur when determining the stopping distances of elevator cars 12 and 14. In any case, controller 18 assures that the following inequality is satisfied when the cars are both stopped under normal stopping conditions:

$$d_{sep}=|y^l-y_t|\geqq d_{thresh} \quad (1),$$

where $y_l$ is the resting position of the leading elevator car (elevator car 14 in the example provided) and $y_t$ is the resting position of the trailing elevator car (elevator car 12 in the example provided).

In order to satisfy inequality (1) when elevator cars 12 and 14 are both moving in the same direction, the controller 18 also continuously (or periodically) determines the normal stopping distance $d_{nst}$ required by the trailing elevator car 12 and shortest stopping distance $d_{ssl}$ required by the leading elevator car 14. In particular, controller 18 controls trailing elevator car 12 to assure that, if leading elevator car 14 stops at maximum deceleration, trailing elevator car 12 may stop at normal deceleration and remain separated from leading elevator car 14 by the threshold distance $d_{thresh}$. Thus, the separation distance $d_{sep}$ is dynamic in the sense that it varies over time and is continuously (or periodically) determined by controller 18 during the time when the trailing elevator car 12 is running.

To understand the dynamic nature of $d_{sep}$, suppose $T_{start}$ is the start time and $T_{end}$ is the end time of a run of trailing elevator car 12. Suppose $x_l(T)$ is the position of the leading car at time T and $x_t(T)$ is the position of the trailing car at time T. The shortest stopping distance of the leading car $d_{ssl}(T)$ is also a function of time since the parameters that the stopping distance is based on (such as speed, acceleration, etc.) also vary over time. For similar reasons, the normal stopping distance $d_{nst}(T)$ also varies over time. Then, the controller 18 ensures that for $T_{start}\leqq T\leqq T_{end}$:

$$d_{sep}(T)=|(x_l(T)+d_{ssl}(T))-(x_t(T)+d_{nst}(T))|\geqq d_{thresh} \quad (2).$$

It is important to note that $d_{sep}$ varies as a function of time whereas $d_{thresh}$ is constant. In light of the dynamic nature of $d_{sep}$, if leading elevator car 12 stops at maximum deceleration, trailing elevator car 12 may be stopped pursuant to normal deceleration parameters anywhere in hoistway 16, so that the resultant stopping position of trailing elevator car 12 is separated from the resultant stopping position of leading elevator car 14 by at least the threshold distance $d_{thresh}$. By controlling separation distance $d_{sep}$ to allow trailing elevator car 12 to come to a stop pursuant to normal deceleration parameters, any negative effect on ride quality for trailing elevator car 12, other than an unexpected stop, is greatly, if not completely, avoided.

If at any time controller 18 determines that actual distance $d_{act}$ between the cars 12 and 14 is less than the required separation distance $d_{sep}$ at that time and that the elevator cars 12 and 14 are traveling in the same direction in hoistway 16, the controller 18 may decrease the speed of trailing elevator car 12 to achieve the required separation distance $d_{sep}$. By decreasing the speed of the trailing car 12, the actual distance $d_{act}$ between leading car 14 and trailing car 12 is increased and the normal stopping distance $d_{nst}$ of trailing elevator car 12 is decreased. Alternatively, controller 18 may stop trailing elevator car 12 pursuant to normal deceleration parameters and resuming starting up the trailing elevator car 12 only when the trailing elevator car 12 can service its original destination without again infringing the separation distance $d_{sep}$.

In some embodiments, controller 18 may delay start-up of trailing elevator car 12 until the distance between trailing elevator car 12 and leading elevator car 14 is large enough to satisfy inequality (2) from the time that trailing elevator car 12 begins moving upwardly to the next destination of the trailing car 12. By doing so, controller 18 may need not make frequent adjustments during the run of elevator car 12 to continually satisfy inequality (2). Specifically, in one embodiment, a method is used to determine if a delay in starting up the trailing elevator car is needed. This method uses predictive motion trajectory models of each car to ensure that the condition in equation (2) is satisfied during the time that both the trailing car and leading car are running in the same direction. Let $\theta_l(T)$ for $0 \leqq T \leqq T_l$ be the predicted position over time T of the leading car following a predictive motion trajectory model where the car begins running from its origin floor level at time 0 and arrives at its destination floor level at time $T_l$, and let $\theta_t(T)$ for $0 \leqq T \leqq T_t$ be the predicted position over time T of the trailing car following a predictive motion trajectory model where the car begins running from its origin floor level at time 0 and arrives its destination floor level at time $T_t$. Suppose at a particular time, the trailing elevator car 12 is at rest at a floor level and is ready to begin running to its destination floor level and the leading elevator car 14 has already been running for $T_{run}$ time units from its origin level to its destination floor level, where $0 \leqq T_{run} \leqq T_l$. In this case, it is possible for controller 18 to allow the trailing elevator 12 to begin running only if the following condition is satisfied.

$$|(\theta_l(T+T_{run})+\pi_{ssl}(T+T_{run}))-(\theta_t(T)+\pi_{nst}(T)| \geqq d_{thresh}, \quad (3)$$

where $0 \leqq T \leqq \min\{T_t, T_l - T_{run}\}$;

$\pi_{nst}(T)$ is the predicted normal stopping distance of the trailing car at time T; and $\pi_{ssl}(T)$ is the predicted shortest stopping distance of the leading car at time T.

Note that as the leading car has already been running for $T_{run}$ time units, the only time when both cars are running is between time 0 and the minimum of either (a) the run time of the trailing car $T_t$ and (b) the remaining time $T_l - T_{run}$ that the leading car is running. If equation (3) is satisfied, the trailing elevator car 12 may begin running without delay. However, if equation (3) is not satisfied, the trailing elevator car 12 may wait for some time interval and recalculate if the condition is satisfied (by then, $T_{run}$ will have increased). Alternatively, it is possible to determine the required delay by finding the smallest $T_{delay} \geqq 0$ that satisfies:

$$|(\theta_l(T+T_{run}+T_{delay})+\pi_{ssl}(T+T_{run}+T_{delay}))-(\theta_t(T)+\pi_{nst}(T)| \geqq d_{thresh}, \quad (4)$$

where $0 \leqq T \leqq \min\{T_t, T_l - T_{run} - T_{delay}\}$.

Note that the predictive motion trajectory models for $\theta_l(T)$, $\pi_{ssl}(T)$, $\theta_t(T)$ and $\pi_{nst}(T)$ may be calculated in the form of a simulation model, numerical model or analytic formula.

In another embodiment, if the lower elevator car 12 is directed to move upwardly, if the upper car 14 is stationary and if the distance between the upper car 14 and the destination of the to be upwardly moving lower elevator car 12 is less than the threshold distance $d_{thresh}$, controller 18 may delay the upward movement of the lower car 12 toward its destination until the upper car 14 can be upwardly moved a sufficient distance so as to satisfy inequality (2). Of course, the upward movement of the upper car 14 could also occur simultaneously with the upward movement of the lower car 12 to its destination. If, however, the upper car 14 is not prepared to move upwardly at the appropriate time (e.g., due to passenger loading/unloading delays), another way to address this potential infringement of $d_{thresh}$ is to have the controller 18 conditionally stop the lower elevator car 12 at a position that satisfies inequality (2).

In a further embodiment, if both cars 12 and 14 are traveling in the same direction in the hoistway 16 and are separated by an actual distance that is much greater than the required separation distance $d_{sep}$, and if the leading car 14 makes an emergency stop, the controller 18 can choose to stop the trailing car 12 in one of three ways. First, the controller could immediately stop the trailing car 12 under normal stopping conditions. Second, the controller 18 could allow the trailing car 12 to continue traveling until the actual distance between the cars 12 and 14 equals the separation distance $d_{sep}$, at which point the controller 18 could cause the trailing car 12 to stop under normal stopping conditions. Third, the controller could cause the trailing car 12 to continue moving a predetermined distance at which point when a stop under normal stopping conditions is initiated, the car 12 will end at a position that will place the car 12 adjacent the hoistway door(s) of a particular floor so that the passengers in the trailing car 12 can exit the car 12 in a normal manner.

It should be noted that while the previous examples were directed to situations in which both elevator cars 12 and 14 are traveling upwardly, a similar algorithm may be applied to elevator system 10 if both elevator cars 12 and 14 are traveling downwardly to service requests. In this case, elevator car 12 would be the leading car and elevator car 14 would be the trailing car.

Figure 2:
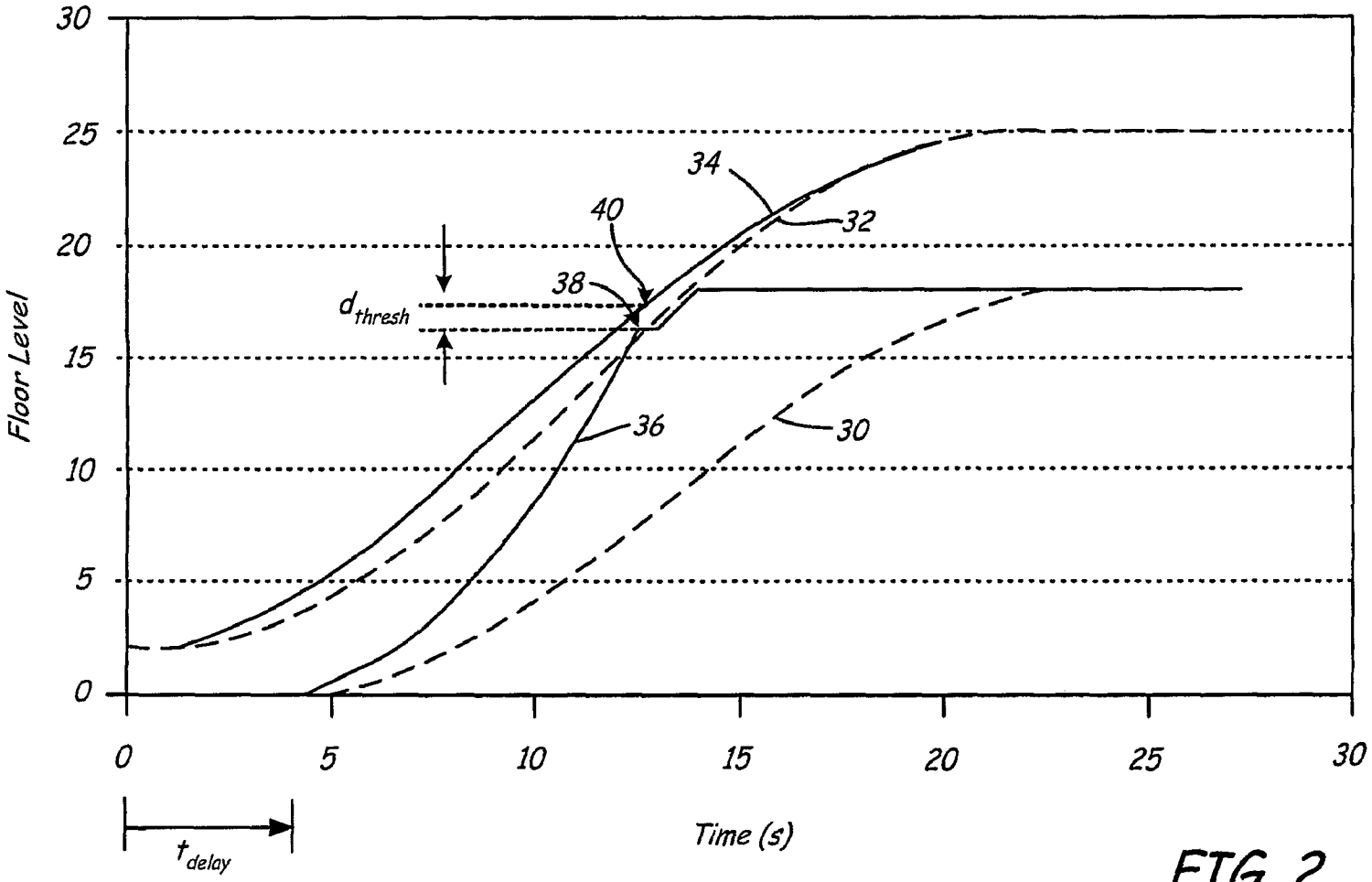
FIG. 2 is a graph that, as a function of time, depicts: (a) the normal running position and emergency stopping position of a leading elevator car; and (b) the normal running position and normal stopping position of a trailing elevator car that is traveling in the same direction as the leading elevator car in the hoistway of FIG. 1.

FIG. 2 is a graph of position $X_l$ of leading elevator car 14 and position $X_t$ of trailing elevator car 12, traveling in the same direction in hoistway 16, as a function of time. In particular, line 30 is position $X_t$ of the trailing elevator car 12 traveling under normal operating conditions as a function of time, and line 32 is position $X_l$ of leading elevator car 14 traveling under normal operating conditions as a function of time pursuant to the motion profile of the leading elevator car 12 stored in the controller 18. Line 34 shows the stopping position $Y_l(T)$ of leading elevator car 14 at maximum deceleration (e.g., when an emergency brake is applied) as a function of time. In other words, if leading elevator car 14 is stopped at maximum deceleration at any time plotted in line 32, the leading elevator car 14 will stop at a corresponding position plotted on line 34 (i.e., $X_l+d_{ssl}$), which corresponding position on line 34 is plotted directly above the time on line 32 at which the maximum deceleration stop is initiated, i.e., although the leading car 14 stops (at the position on line 34) at a time that is after the time (on line 32) at which the maximum deceleration stop is initiated, the stopping location (on line 34) is shown at the same time for ease of viewing. Line 36 shows the stopping position $Y_t(T)$ of trailing elevator car 12 under normal deceleration conditions as a function of time pursuant to the motion profile of trailing elevator car 12 stored in controller 18. In other words, if trailing elevator car 12 is stopped under normal deceleration conditions at any time plotted in line 30, the trailing elevator car 12 will stop at a corresponding position plotted on line 36 (i.e., $X_t+d_{nst}$), which corresponding position on line 36 is plotted directly above the time on line 30 at which the normal deceleration stop is initiated, i.e., although the trailing car 12 stops (at the position on line 36) at a time that is after the time (on line 30) at which the normal deceleration stop is initiated, the stopping location (on line 36) is shown at the same time for ease of viewing.

In order to assure elevator cars 12 and 14 are separated by separation distance $d_{sep}$ from the beginning of their run, elevator car 14 begins its upward motion at time 0 s, as shown by line 32, while elevator car 12 is held at its initial position, as shown by line 30. The time during which the elevator car 12 is held at its initial position is labeled as delay time $t_{delay}$. In the embodiment shown, delay time $t_{delay}$ is approximately 3.72 s. When delay time $t_{delay}$ has passed, controller 18 starts elevator car 12 moving upwardly. In some embodiments, delay time $t_{delay}$ is set such that inequality (2) is satisfied from the time that trailing elevator car 12 begins moving upwardly until all service requests of trailing elevator car 12 in the upward direction are satisfied. In other words, delay time $t_{delay}$ may be set so that controller 18 need not make frequent adjustments during the run of trailing elevator car 12 to continually satisfy inequality (4). In other embodiments, $t_{delay}$ could be greater than necessary so as to provide a safety time cushion into the elevator system 10, which safety time cushion could account for any errors in the determination of the separation distance $d_{sep}$. By allowing trailing elevator car 12 to follow leading elevator car 14 as closely as possible while assuring $d_{sep}$ such that the trailing car 12 can always stop under normal deceleration conditions, the dispatching performance of elevator system 10 is improved in a way that takes safety and ride quality considerations into account.

In another embodiment of the present invention, if the cars 12 and 14 are scheduled to move in the same direction but are separated by an actual distance that is much greater than the separation distance $d_{sep}$, the trailing car 12 may be instructed to move before the leading car 14 is instructed to move. In this way, the time delay for the leading car 14 is essentially a negative time delay. Of course, if, for whatever reason, the leading car 14 does not start moving as originally planned and the actual distance between the cars 12 and 14 becomes equal to the separation distance $d_{sep}$, the controller 18 may instruct the trailing car 12 to make a conditional stop under normal stopping conditions. Similarly, if the destination of the trailing car 12 conflicts with the current position of the leading car 14, the controller may instruct the trailing car 12 to make a conditional stop under normal stopping conditions until the leading car 14 begins moving away from the trailing car 12, thereby enabling the trailing car 12 to reach its destination.

Controller 18 monitors the separation between elevator car 12 and elevator car 14 to assure that the distance between the normal stopping position of trailing elevator car 12 plotted on line 36 and the shortest stopping position of leading elevator car 14 plotted on line 34 is always maintained at or greater than the threshold distance $d_{thresh}$. For example, at about time 12.5 s, the stopping position 38 (at about the $16^{th}$ floor) of trailing elevator car 12 under normal deceleration conditions is at the programmed threshold distance $d_{thresh}$ from the stopping position 40 (at about the $17^{th}$ floor) of leading elevator car 14 under maximum deceleration conditions.

The present invention relates to maintaining a separation distance between a leading elevator car and a trailing elevator car traveling in the same direction in an elevator hoistway. A shortest stopping distance of the leading elevator car and a normal stopping distance of the trailing elevator car are continuously (or periodically) determined. The separation distance is controlled such that at any time the difference between the normal stopping distance of the trailing elevator car and the shortest stopping distance of the leading elevator car is greater than or equal to the threshold distance. By controlling the separation distance of adjacent elevator cars traveling in the same direction, interference between adjacent cars is avoided even during emergency situations of the leading car. In addition, if the leading car needs to make a sudden, emergency stop, the trailing car may come to a stop pursuant to normal deceleration parameters, thereby minimizing the effect on ride quality for the trailing car. At the same time, by allowing the trailing car to follow the leading car as closely as possible while assuring the separation distance such that the trailing car can always stop under normal deceleration conditions, the dispatching performance of the elevator system is improved in a way that takes safety and ride quality considerations into account. The aforementioned discussion is intended to be merely illustrative of the present invention and should not be construed as limiting the appended claims to any particular embodiment or group of embodiments. Thus, while the present invention has been described in particular detail with reference to specific exemplary embodiments thereof, it should also be appreciated that numerous modifications and changes may be made thereto without departing from the broader and intended scope of the invention as set forth in the claims that follow.

The specification and drawings are accordingly to be regarded in an illustrative manner and are not intended to limit the scope of the appended claims. In light of the foregoing disclosure of the present invention, one versed in the art would appreciate that there may be other embodiments and modifications within the scope of the present invention. Accordingly, all modifications attainable by one versed in the art from the present disclosure within the scope of the present invention are to be included as further embodiments of the present invention. The scope of the present invention is to be defined as set forth in the following claims.

The invention claimed is:

1. A method for maintaining a separation distance between a leading elevator car and a trailing elevator car traveling in the same direction in an elevator hoistway, the method comprising the steps of:

(a) determining a shortest stopping distance of the leading elevator car and a normal stopping distance of the trailing elevator car; and (b) controlling the separation distance between the leading elevator car and the trailing elevator such that a difference between the normal stopping distance of the trailing elevator car and the shortest stopping distance of the leading elevator car is greater than or equal to a threshold distance.

2. The method of claim 1, and further comprising:

(c) repeating, iteratively, steps (a) and (b) while the leading and/or trailing elevator cars is/are moving in the hoistway.

3. The method of claim 1, wherein before the leading and trailing elevator cars begin traveling in the same direction in the hoistway, the step of controlling comprises:

delaying start-up of the trailing elevator car until the distance between the leading elevator car and the trailing elevator car is such that the leading and trailing elevator cars are separated by at least the separation distance while the leading and trailing elevator cars are traveling in the same direction in the hoistway.

4. The method of claim 3, wherein the step of delaying start-up of the trailing elevator car comprises:

determining $0 \leqq T \leqq T_t$ during which the trailing car will be moving, a projected location $\theta_t$ and projected normal stopping distance $\pi_{nst}$ of the trailing car;

determining $0 \leqq T \leqq T_l$ during which the leading car will be moving, a projected location $\theta_l$ and projected shortest stopping distance $\pi_{ssl}$ of the leading car; and calculating whether the following condition is satisfied:

$$|(\theta_l(T+T_{run})+\pi_{ssl}(T+T_{run}))-(\theta_t(T)+\pi_{nst}(T)| \geqq d_{thresh},$$

where $0 \leqq T \leqq \min\{T_t, T_l - T_{run}\}$, wherein $T_{run}$ is a time during which the leading car has already traveled, wherein $d_{thresh}$ is the threshold distance, and wherein $0 \leqq T_{run} \leqq T_l$.

5. The method of claim 1, wherein if the difference between the normal stopping distance of the trailing elevator car and the shortest stopping distance of the leading elevator car is less than the threshold distance, the step of controlling the trailing elevator car comprises:

(a) decreasing the speed of the trailing elevator car; or (b) stop the trailing car.

6. The method of claim 1, wherein the step of determining the shortest stopping distance of the leading elevator car comprises:

measuring at least one parameter of the leading elevator car selected from the group consisting of the speed, direction, acceleration, load, and jerk of the leading elevator car.

7. The method of claim 6, wherein the step of determining the shortest stopping distance of the leading elevator car further comprises:

calculating the stopping distance at maximum deceleration of the leading elevator car based on the at least one measured parameter of the leading elevator car.

8. The method of claim 1, wherein the shortest stopping distance of the leading car is a stopping distance during an emergency condition.

9. The method of claim 1, wherein the step of determining the normal stopping distance of the trailing elevator car comprises:

measuring at least one parameter of the trailing elevator car selected from the group consisting of the speed, direction, acceleration, load, and jerk of the trailing elevator car.

10. The method of claim 9, wherein the step of determining the normal stopping distance of the trailing elevator car further comprises:

calculating the stopping distance of the trailing elevator car at a controlled deceleration rate based on the at least one measured parameter of the trailing elevator car.

11. The method of claim 1, wherein the threshold distance is at least about one floor level.

12. An elevator system comprising:

a hoistway;

first and second elevator cars in the hoistway; and a controller configured to (a) operate the first and second elevator cars, wherein when the first and second elevator cars are operated in the same direction in the elevator hoistway, one of the first and second elevator cars is a leading elevator car and the other of the first and second elevator cars is a trailing elevator car, and (b) maintain a separation distance between the first and second elevator cars such that a difference between a normal stopping distance of the trailing elevator car and a shortest stopping distance of the leading elevator car is greater than or equal to a threshold distance.

13. The elevator system of claim 12, wherein the normal stopping distance of the trailing car is a function of at least one parameter of the trailing elevator car selected from the group consisting of the speed, direction, acceleration, load, and jerk of the trailing elevator car under normal operating conditions.

14. The elevator system of claim 12, wherein the shortest stopping distance of the leading car is a function of at least one parameter of the leading elevator car selected from the group consisting of the speed, direction, acceleration, load, and jerk of the leading elevator car under emergency operating conditions.

15. The elevator system of claim 12, wherein the shortest stopping distance is a stopping distance during an emergency condition.

16. The elevator system of claim 12, wherein the controller is further configured to delay start-up of the trailing elevator car until the distance between the leading elevator car and the trailing elevator car is such that the leading and trailing elevator cars remain separated by at least the separation distance while the leading and trailing elevator cars are traveling in the same direction in the hoistway.

17. The elevator system of claim 16, wherein the controller is configured to delay start-up of the trailing elevator car by:

determining $0 \leqq T \leqq T_t$ during which the trailing car will be moving, a projected location $\theta_l$ and projected normal stopping distance $\pi_{nst}$ of the trailing car;

determining $0 \leqq T \leqq T_t$ during which the leading car will be moving, a projected location $\theta_l$ and projected shortest stopping distance $\pi_{ssl}$ of the leading car; and calculating whether the following condition is satisfied:

$$|(\theta_l(T+T_{run})+\pi_{ssl}(T+T_{run}))-(\theta_t(T)+\pi_{nst}(T)| \geqq d_{thresh},$$

where $0 \leqq T \leqq \min\{T_t, T_l - T_{run}\}$, wherein $T_{run}$ is a time during which the leading car has already traveled, wherein $d_{thresh}$ is the threshold distance, and wherein $0 \leqq T_{run} \leqq T_l$.

18. The elevator system of claim 12, wherein the threshold distance is at least about one floor level.

19. The elevator system of claim 12, wherein if the difference between the normal stopping distance of the trailing elevator car and the shortest stopping distance of the leading elevator car is less than the threshold distance, the controller is configured to:

(a) decrease the speed of the trailing elevator car; or (b) stop the trailing car.

* * * * *

UNITED STATES PATENT AND TRADEMARK OFFICE

CERTIFICATE OF CORRECTION

PATENT NO. : 8,434,599 B2
APPLICATION NO. : 12/678880
DATED : May 7, 2013
INVENTOR(S) : Cheng-Shuo Wang et al.

It is certified that error appears in the above-identified patent and that said Letters Patent is hereby corrected as shown below:

In the Specification

Col. 3, Line 53
Insert --of-- before "trailing elevator car 12"

Signed and Sealed this
Twenty-ninth Day of October, 2013

Teresa Stanek Rea
*Deputy Director of the United States Patent and Trademark Office*